US007009478B2

(12) United States Patent
Ermert et al.

(10) Patent No.: US 7,009,478 B2
(45) Date of Patent: Mar. 7, 2006

(54) SOLENOID ARRANGEMENT

(75) Inventors: Michael Ermert, Kirburg (DE); Bernd Hage, Neunkirchen (DE)

(73) Assignee: Thomas Magnete GmbH, HerdorF (DE)

( * ) Notice: Subject to any disclaimer, the term of this patent is extended or adjusted under 35 U.S.C. 154(b) by 0 days.

(21) Appl. No.: 10/647,129

(22) Filed: Aug. 22, 2003

(65) Prior Publication Data

US 2004/0135658 A1 Jul. 15, 2004

(30) Foreign Application Priority Data

Aug. 23, 2002 (DE) ..... 102 38 840

(51) Int. Cl.
*H01F 7/08* (2006.01)

(52) U.S. Cl. ..... 335/220; 335/251; 251/129.15

(58) Field of Classification Search ..... 335/220–234, 335/251–256, 281–282; 251/129.01–129.29
See application file for complete search history.

(56) References Cited

U.S. PATENT DOCUMENTS 5,402,824 A * 4/1995 Hosoya et al. ..... 137/596.17
6,138,986 A * 10/2000 Krimmer et al. ..... 251/129.02

* cited by examiner

*Primary Examiner*—Lincoln Donovan
(74) *Attorney, Agent, or Firm*—Friedrich Kueffner

(57) ABSTRACT

A solenoid arrangement has at least one excitation coil and an armature arranged concentrically relative to the excitation coil and axially movable when the at least one excitation coil is supplied with current. A magnetizable cup-shaped housing part open at a first axial side is provided, wherein the at least one excitation coil is at least partially surrounded by the magnetizable cup-shaped housing part. A magnetizable yoke covers the first axial side for closing the magnetic circuit. A housing cover covering the solenoid arrangement is formed of plastic material, wherein the plastic material has at least one attachment flange for mounting the solenoid arrangement on other parts.

7 Claims, 4 Drawing Sheets

SOLENOID ARRANGEMENT

BACKGROUND OF THE INVENTION

1. Field of the Invention

The invention relates to a solenoid arrangement comprising at least one excitation coil and an armature arranged concentrically relative to the excitation coil and axially movable when the excitation coil is supplied with current, wherein the excitation coil is at least partially surrounded by a magnetizable cup-shaped housing part open at one axial side and wherein the open side can be covered for further closing the magnetic circuit by a magnetizable yoke, and wherein the solenoid arrangement is closed off by a housing cover. The invention also relates to a control member for affecting fluid flow. The invention moreover relates to a method for producing a solenoid arrangement comprising at least one excitation coil and an armature arranged concentrically relative to the excitation coil and axially movable when the excitation coil is supplied with current, wherein the excitation coil is at least partially surrounded by a magnetizable cup-shaped housing part open at one axial side and wherein the open side can be covered for further closing the magnetic circuit by a magnetizable yoke.

2. Description of the Related Art

Switchable solenoid arrangements of the aforementioned kind serve for effecting different switching states of, for example, valves or other functional elements. The solenoid arrangements can be used, for example, in mobile environments such as motor vehicles. For example, in the case of motor vehicles, a typical application is valve control wherein the valve slide can rotate together with a camshaft. Therefore, high seal-tightness requirements must be fulfilled for enabling oil lubrication in the area of the armature of the solenoid arrangement.

Such solenoid arrangements are to be connected mechanically to the internal combustion engine, wherein according to the prior art steel housings with attachment flanges are provided which enclose the armature and the sealing sleeve surrounding it, the inner excitation coil, and the yoke. The steel housing however increases the weight greatly and causes relatively high component costs.

SUMMARY OF THE INVENTION

It is an object of the present invention to lower the weight of a solenoid arrangement or of a control member including such solenoid arrangement while providing a high mechanical reliability despite the lowered weight.

In accordance with the present invention, this is achieved in that the housing cover is formed by plastic material and in that the plastic material provides at least one attachment flange for mounting the solenoid arrangement on other parts. In connection with the control member this object is achieved in that the control member comprises a solenoid arrangement embodied according to the present invention as well as at least one valve slide, in particular, a four/three-way directional control valve actuated by the plunger of the solenoid arrangement. In connection with the manufacturing method, this object is achieved in that the cup-shaped housing part, the excitation coil, and the yoke are inserted into an injection molding device and the cup-shaped housing part and the yoke are secured in a contacting way relative to one another by injection of a plastic material.

The configuration of the solenoid arrangement according to the invention enables the elimination of a heavy steel housing with fastening flange without the mechanical stability of the solenoid arrangement being compromised.

When advantageously attachment flanges provided for attachment of the solenoid arrangement to parts for holding them, for example, a vehicle engine, are embedded in the plastic material, not only the solenoid arrangement is very stable in itself and of a mechanically long-lasting configuration, but it can also be secured with a minimal component expenditure overall.

The number of components is further reduced when the plastic material also contains integral holders for electrical connector plugs.

When the armature of the solenoid arrangement is secured in a sealed sleeve, it can be movable in an oil bath so that use of the solenoid arrangement for adjusting rotating parts, such as a camshaft, is enabled.

In this connection, it is particularly favorable when the plunger, for example, connected by pressing (press-fit) to the armature and acting on a valve slide, is provided with a ball at the end projecting from the solenoid arrangement and facing the valve slide or a similar functional part because, in this way, possible wear caused not only by rotational movement of the valve slide but also by a displacement of the axial positions of the solenoid arrangement and of the valve slide relative to one another can be minimized. When using a steel ball, the wear is significantly minimized because its surface hardness can be high.

Sealing of the armature and of the plunger can be ensured by means of a sleeve closed off at one end, wherein the sleeve is welded axially onto an area of the cup-shaped housing part. By means of the axial weld connection, the guide member surrounded by the magnetizable sleeve and the cup-shaped housing part can radially adjoin one another and, in this way, continuous magnetic flux is ensured.

In particular, such a solenoid arrangement can be a component of a control member which comprises additionally one or several members to be adjusted, for example, a valve slide. A particularly suitable application of such a control device is the use as a camshaft adjuster, for example, when the valve slide controls an adjusting motor for a camshaft. By separating the solenoid arrangement from the valve effecting the adjustment, the length of the control member can be shortened in comparison to prior art camshaft adjusters in which the armature and the valve form a modular unit. The requirements with regard to support and positional adjustment are significantly reduced.

Manufacture of the solenoid arrangement according to the invention can be achieved by an injection mold which has separate holding-down devices for pressing the yoke onto the cup-shaped housing part. These holding-down devices (rams) can be pulled out of the hardenable plastic material. The remaining holes can be filled subsequently with additional plastic material by injection.

DESCRIPTION OF THE PREFERRED EMBODIMENTS

Figure 1:
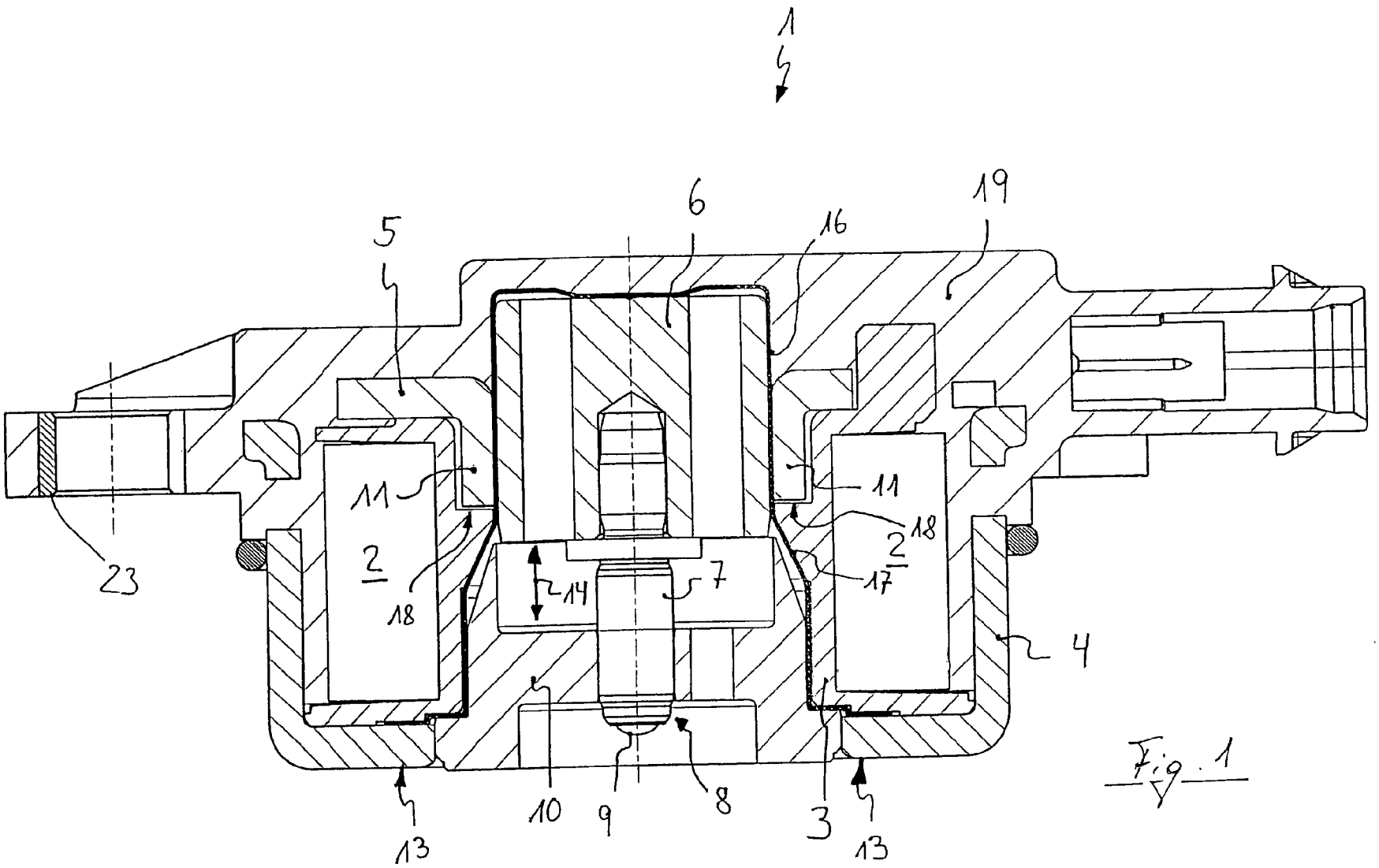
FIG. 1 shows a solenoid arrangement according to the invention in a section view.
Figure 2:
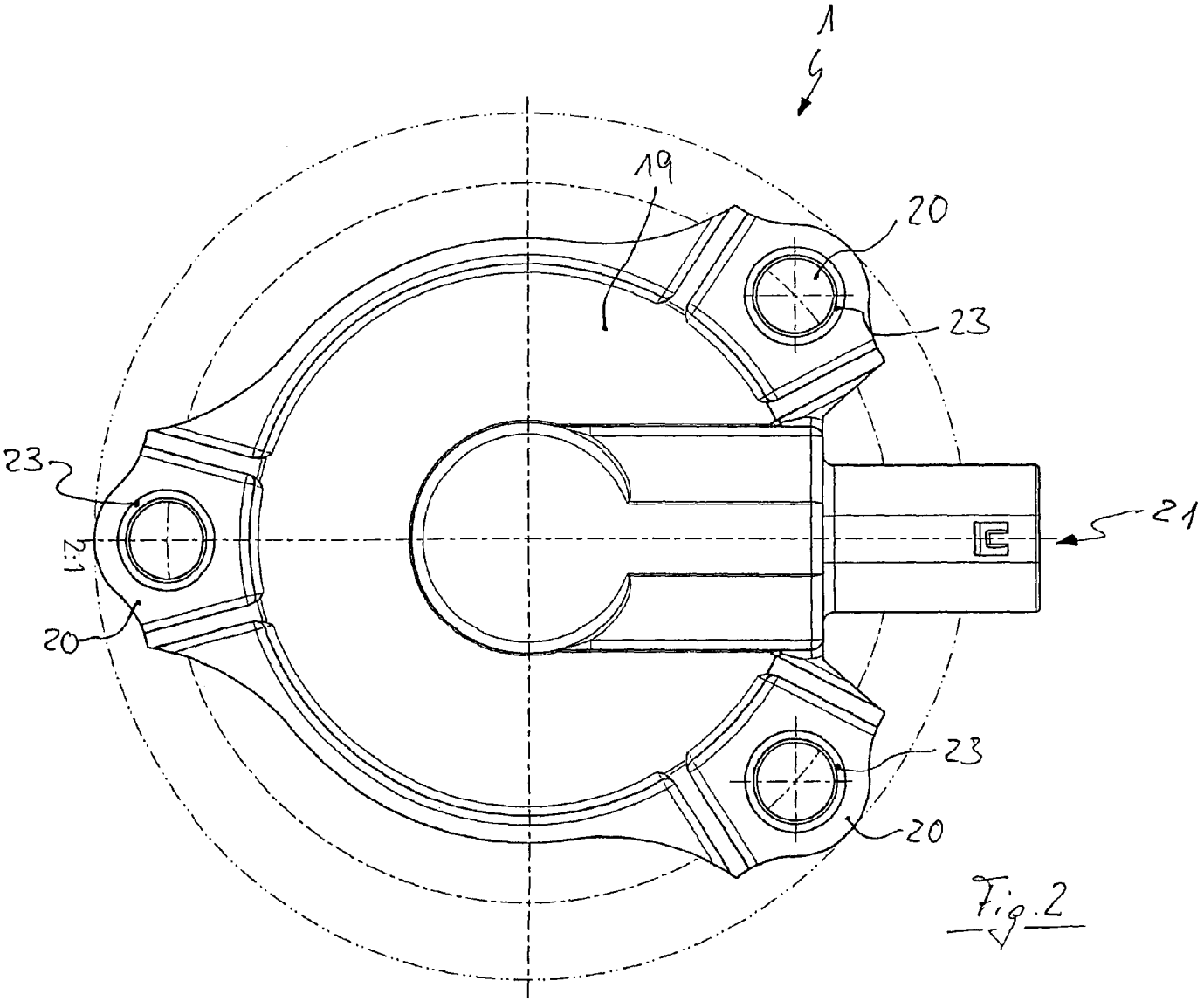
FIG. 2 shows the solenoid arrangement according to the invention of FIG. 1 in a plan view.

FIG. 1 illustrates a solenoid arrangement 1 according to the invention that operates, for example, proportionally magnetically. It comprises an excitation coil 2 which is secured on a coil support 3, for example, made of plastic material. The coil support 3 and the excitation coil 2 are positioned in a magnetizable cup-shaped housing part 4. A substantially plate-shaped magnetizable yoke 5 forms an axial closure of the open cup-shaped housing part 4. At the center of the excitation coil 2 an axially moveable armature 6 is supported. The armature 6 supports centrally a plunger 7 which is the actual switching element for further functional parts, for example, a valve slide. The leading end 8 of the plunger 7 projecting out of the solenoid arrangement is provided with a ball 9. The plunger 7 is axially movably held in a fixedly mounted or fitted guide member 10. The guide member 10 is cone-shaped and secured axially underneath and at a spacing to the axially extending flange areas 11 of the yoke 5. It is positioned in a recess 12 of the cup-shaped housing part 4 and adjoins radially directly the surrounding edge area 13 of the recess 12. In this way, magnetic flux between these parts is ensured.

The axial spacing between the cone-shaped guide member 10 and the flange areas 11 of the yoke 5 causes an air gap to be bridged by the magnetic flux lines so that upon current supply of the excitation coil 2 an axial force acts on the armature 6. The armature 6 is thus movable in the direction of the arrow 14 and its movement entrains the plunger 7 which is press-fit into it.

The armature 6 with the secured plunger 7 as well as the cone-shaped guide member 10 are secured in the pressure-tight chamber 15. The chamber 15 is sealed by a sleeve 16. The sleeve 16 is axially secured on the rim area 13 of the cup-shaped housing part 4 surrounding the recess 12, for example, by means of laser welding, and enables in this way the direct radial contacting of the cup-shaped housing part 4 and the cone-shaped guide member 10 for ensuring interruption-free magnetic flux. In order to ensure the exact alignment of sleeve 16 and cup-shaped housing part 4 during welding, a centering pin, for example, can be provided.

Figure 3:
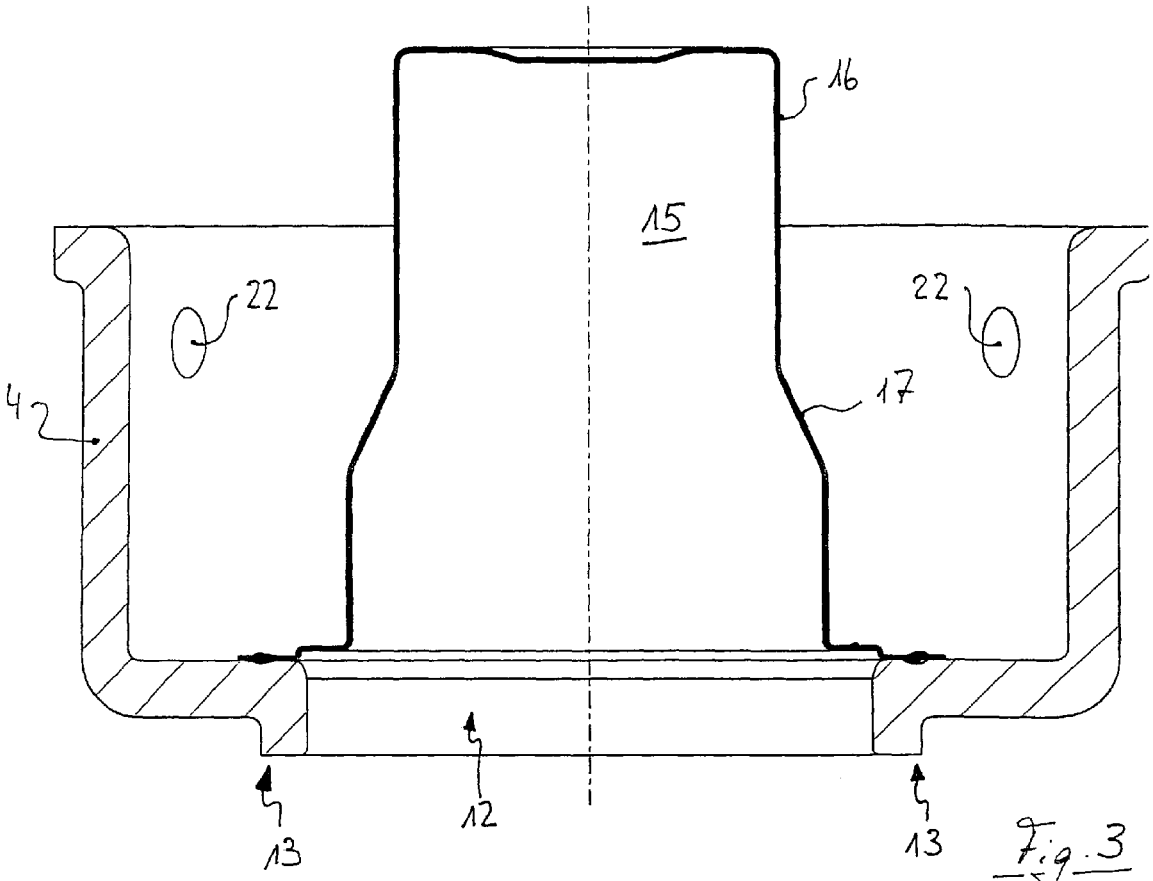
FIG. 3 shows the housing part embodied as a cup with sleeve welded thereto for sealing the chamber for the magnetic armature and the plunger.

The connection between the sleeve 16 and the cup-shaped housing part 4 is illustrated in detail in FIG. 3. The sleeve 16 itself can be comprised of non-magnetizable stainless steel or a similar material. It has only a mechanical function and a sealing function but no magnetic function. The sleeve 16 comprises a shoulder 17 on which is supported, on the one hand, the conical guide member 10 in the pressure-tight chamber 15 and, on the other hand, the coil support 3 on the exterior.

Figure 4:
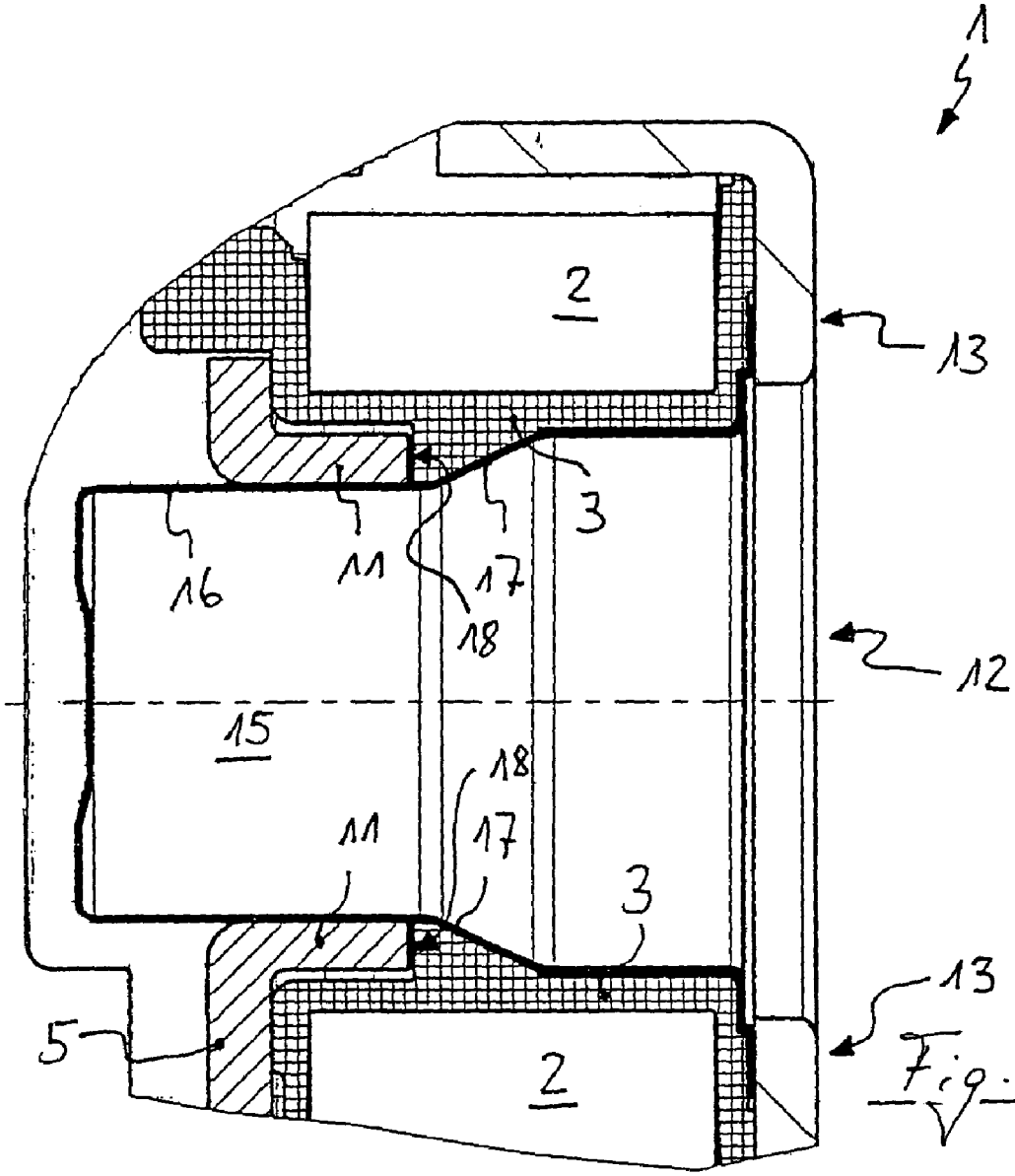
FIG. 4 shows a view similar to FIG. 3 showing in addition the coil support and the yoke.

Moreover, on the exterior of the sleeve 16 and on a radially inner step 18 of the coil support 3, flange areas 11 of the yoke 5 are supported. Sleeve 16, coil support 3, and flange areas 11 of the yoke 5 therefore adjoin one another positive-lockingly and tightly (FIG. 4).

According to the invention, the parts thus combined are inserted into an injection mold and are fixedly connected to one another by injecting the plastic material 19. One or several holding-down devices are provided in the injection molding device by which the yoke 5 is pressed onto the cup-shaped housing part 4 so that in the solenoid arrangement 1 manufactured accordingly an interruption of the magnetic flux between the aforementioned parts cannot result. The holding-down devices can be removed during the hardening process of the plastic material 19. For closing the resulting channels in the plastic material, the additional plastic material 19 can be added by injection. Moreover, in the sidewall of the cup-shaped housing part 4 injection openings 22 are provided so that also the space between the excitation coil 2 and the cup-shaped housing part 4 can be filled with plastic material 19 so that the excitation coil 2 is secured fixedly and vibration-free.

By embedding the solenoid in the plastic material 19, the weight of the solenoid arrangement 1 is significantly reduced.

In the shown embodiment, the injection mold is configured such that the plastic material 19 is at the same time an attachment flange for the entire solenoid arrangement 1. For this purpose, with a corresponding configuration of the injection mold fastening means 20, for example, bores for fastening screws, are formed in the plastic material 19. A metal reinforcement 23 of the fastening means 20 can be provided. In addition to the mechanical fastening means 20, a plug 21 for electrical contacting of the excitation coil 2 is integrally formed in the plastic material 19. In this way, a particularly compact configuration by using a minimum of components is ensured. Even in a situation where external vibrations are present during operation, a stable connection of all embedded parts is ensured. As an additional function, the plastic material 19 also provides insulation of the current-carrying parts externally and in the outward direction.

By means of the solenoid arrangement 1, a control member can be formed in which a valve slide is no longer formed as a modular unit together with the armature 6 of the solenoid arrangement 1 but is decoupled from it. In this way, the axial length of the control member can be significantly reduced. The valve slide can be loaded by the plunger 7 in pressure operation against a restoring spring.

The geometric shape of the solenoid arrangement 1 is variable and can be designed according to the specific requirements. The same holds true also for the mounting position of such solenoid arrangements 1. Also, the materials can be selected according to pressure and temperature requirements as well as mechanical requirements.

While specific embodiments of the invention have been shown and described in detail to illustrate the inventive principles, it will be understood that the invention may be embodied otherwise without departing from such principles.

What is claimed is:

1. A solenoid arrangement comprising:

at least one excitation coil;

an armature arranged concentrically relative to the excitation coil and axially movable when the at least one excitation coil is supplied with current;

a magnetizable cup-shaped housing part open at a first axial side, wherein the at least one excitation coil is at least partially surrounded by the magnetizable cup-shaped housing part;

a magnetizable yoke, wherein the first axial side is covered for closing the magnetic circuit by the magnetizable yoke;

a housing cover covering the solenoid arrangement and formed of plastic material, wherein the plastic material has at least one attachment flange for mounting the solenoid arrangement further comprising a sleeve axially welded onto a rim area of the cup-shaped housing part, and a guide member contacting the cup-shaped housing part, wherein the armature has a plunger guided in the guide member, and wherein the plunger has an end projecting from the guide member, and the end has a ball.

2. The solenoid arrangement according to claim 1, further comprising contacts of an electric plug for contacting the at least one excitation coil, wherein the contacts are embedded in the plastic material and wherein the plastic material forms a plug housing of the electric plug.

3. The solenoid arrangement according to claim 1, wherein the cup-shaped housing part and the yoke are secured in the plastic material in a position so as to contact one another.

4. The solenoid arrangement according to claim 1, wherein the guide member and the armature are enclosed by the sleeve, wherein the sleeve is sealed and supports the armature so as to be axially movable in the sleeve.

5. The solenoid arrangement according to claim 1, wherein the ball is rotatably supported.

6. A control member for effecting a fluid flow, comprising a solenoid arrangement according to claim 1 and further comprising a valve slide.

7. The control member according to claim 6, wherein the valve slide is a 4/3 directional control valve switched by the plunger of the solenoid arrangement.

* * * * *